US005826605A

United States Patent [19]

Hilton

[11] Patent Number: 5,826,605

[45] Date of Patent: Oct. 27, 1998

[54] IMPACT RESPONSIVE EXTENDIBLE ARM PICK-UP FOR WALKING CANE OR THE LIKE

[76] Inventor: William W. Hilton, 6717 NW. 58 Ct., Tamarac, Fla. 33321

[21] Appl. No.: 824,499

[22] Filed: Mar. 26, 1997

[51] Int. Cl.[6] ..... A45B 3/00

[52] U.S. Cl. ..... 135/66; 135/65; 135/74; 135/77; 135/911

[58] Field of Search ..... 135/16, 66, 65, 135/74, 77, 911

[56] References Cited

U.S. PATENT DOCUMENTS

| | | | |
|---|---|---|---|
| 1,270,973 | 7/1918 | Rosenwasser | 135/65 X |
| 3,029,828 | 4/1962 | Kravitt | 135/66 |
| 3,158,851 | 11/1964 | Ruthven | 135/66 |
| 4,091,828 | 5/1978 | Jorgensen | 135/66 |
| 4,121,605 | 10/1978 | Schmerl | 135/65 |
| 4,237,915 | 12/1980 | Zabielski et al. | 135/74 X |
| 4,358,138 | 11/1982 | Laughlin et al. | 135/66 X |
| 4,811,750 | 3/1989 | McAllister | 135/66 |
| 4,884,730 | 12/1989 | Carpenter | 135/66 X |
| 5,176,160 | 1/1993 | Osborn | 135/66 |
| 5,433,234 | 7/1995 | Lapere | 135/66 |

FOREIGN PATENT DOCUMENTS

| | | | |
|---|---|---|---|
| 1016156 | 2/1952 | France | 135/66 |
| 609945 | 2/1935 | Germany | 135/66 |
| 868541 | 5/1961 | United Kingdom | 135/66 |

*Primary Examiner*—Wynn E. Wood
*Attorney, Agent, or Firm*—Harold W. Hilton

[57] ABSTRACT

An actuator mechanism for extending an arm from a fallen elongated walking appliance, such as a walking cane or crutch, to enable the appliance to be retrieved without requiring any bending over by the person retrieving the appliance. At least one elongated arm is spring biased to the actuator mechanism and the actuator mechanism includes means for extending the arm therefrom responsive to impact of the actuator mechanism with the surface upon which the object or cane has fallen.

27 Claims, 13 Drawing Sheets

IMPACT RESPONSIVE EXTENDIBLE ARM PICK-UP FOR WALKING CANE OR THE LIKE

FIELD OF THE INVENTION

The present invention relates to walking appliances and more particularly to an impact responsive actuator for a walking appliance which extends an arm from the appliance so as to permit the appliance to be picked up by a person unable to bend down.

BACKGROUND OF THE INVENTION

Many people suffer from chronic back, hip or other movement restricting conditions that are both painful and very limiting. Such people often find simple tasks such as bending over to pick up an object, such as a walking cane or crutch, which has inadvertently fallen to the floor or other surface, nearly impossible. People who have had hip replacement surgery, in particular, are restricted in this bending movement.

Some prior art patents such as U.S. Pat. Nos. 5,392,800, 5,392,801 and 5,947,882 address the problem of "bending over" to pick up a fallen cane. U.S. Pat. No. 5,392,800 is directed to a multi-purpose cane device and includes a rod positioned on the resilient foot portion or pad which covers the distal end of the cane. The rod remains in extended position while the cane is being used. The user must place his or her foot on the extending rod and apply a force by foot pressure which will cause the cane handle to swing upwardly. It should be obvious that if the cane should fall on the side from which the rod extends, the rod would be faced downwardly away from the user and thereby be inaccessible to contact by the user's foot. Additionally, the force required to rotate the cane upwardly by application of foot pressure on the extending rod would require that the hip joint of the user be placed under a great amount of stress causing pain and discomfort or even further injury to the already weakened hip joint.

U.S. Pat. No. 5,392,801 is directed to a self-righting walking cane having a weighted base provided with a center of gravity positioned below the center of rotation of the device. An unbalanced movement exists because of this relationship which causes the cane to roll on the surface to which it has fallen, and, right itself. A first problem that the user encounters in this device is the large mass which is positioned at the base of the cane and must be carried by the user. Additionally, such large mass would be continuously engaged by the foot of the user during the normal course of walking unless a special effort was made by the user to hold the cane further away from his or her body to provide a space between the large mass and the foot.

U.S. Pat. No. 4,947,882 is directed to crutches, walking sticks, and the like. U.S. Pat. No. 4,947,882 discloses a device which, like the device of U.S. Pat. No. 5,392,801, requires the user to apply a force to the base to raise the cane to its upright position.

The above mentioned difficulties are overcome by the actuator mechanism of the present invention which eliminates the need for any contact with the fallen walking appliance by the user in order to position the appliance in an upright position to enable the user to retrieve the appliance.

SUMMARY OF THE INVENTION

The actuator of the present invention is automatically operable responsive to impact of the actuator with the surface upon which the cane has fallen. Upon impact an arm is extended normal to the cane. The user merely grips the extended arm to retrieve the cane without bending over.

It is an object, therefore, of the present invention to provide mechanism for easily retrieving a fallen cane without the user having to bend over.

It is a further object of the present invention to provide an actuator for attachment to a cane which extends an arm in normal relation to the cane solely responsive to impact of the actuator with a surface such as a floor, walkway, street, etc.

These and other objects and advantages of the present invention will become more readily apparent from the following drawings and detailed description.

DESCRIPTION OF THE PREFERRED EMBODIMENTS

Figure 1:
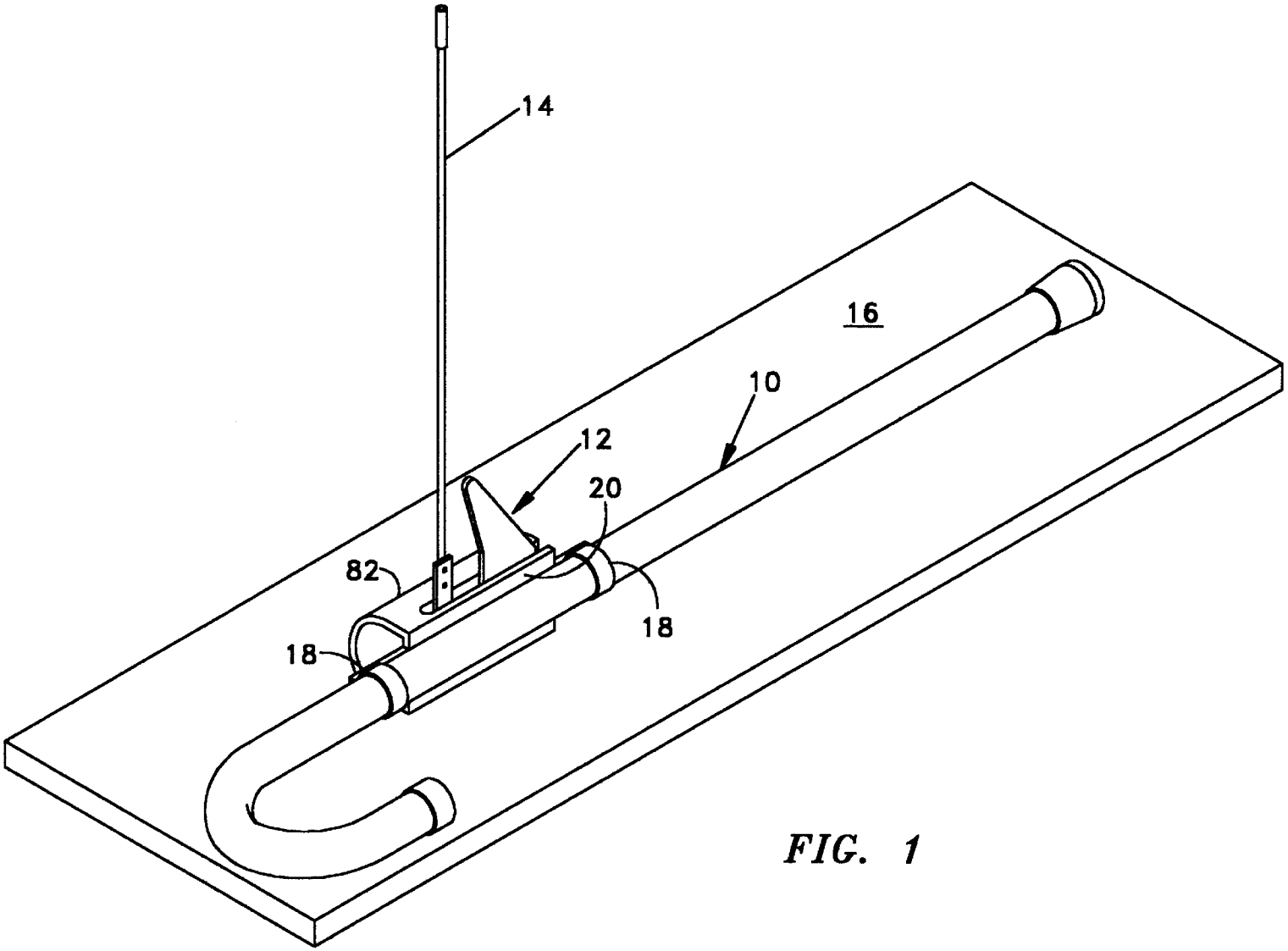
FIG. 1 is a pictorial view of a cane resting on a surface on which it has fallen. The cane is shown to have an extendible pick-up arm which provides a means for the cane user to pick up the cane without bending.

As seen in FIG. 1, a walking cane 10 is shown to be provided with an actuator mechanism 12 for extending an arm 14 in substantially normal relation to the longitudinal axis of the cane responsive to impact of the actuator mechanism 12 with a surface 16 such as a floor, street, etc. onto which the cane has inadvertently fallen. The extending arm 14 permits the cane user to retrieve the fallen cane without bending over. Actuator mechanism 12 is shown to be secured to cane 10 by clamps 18.

Figure 2:
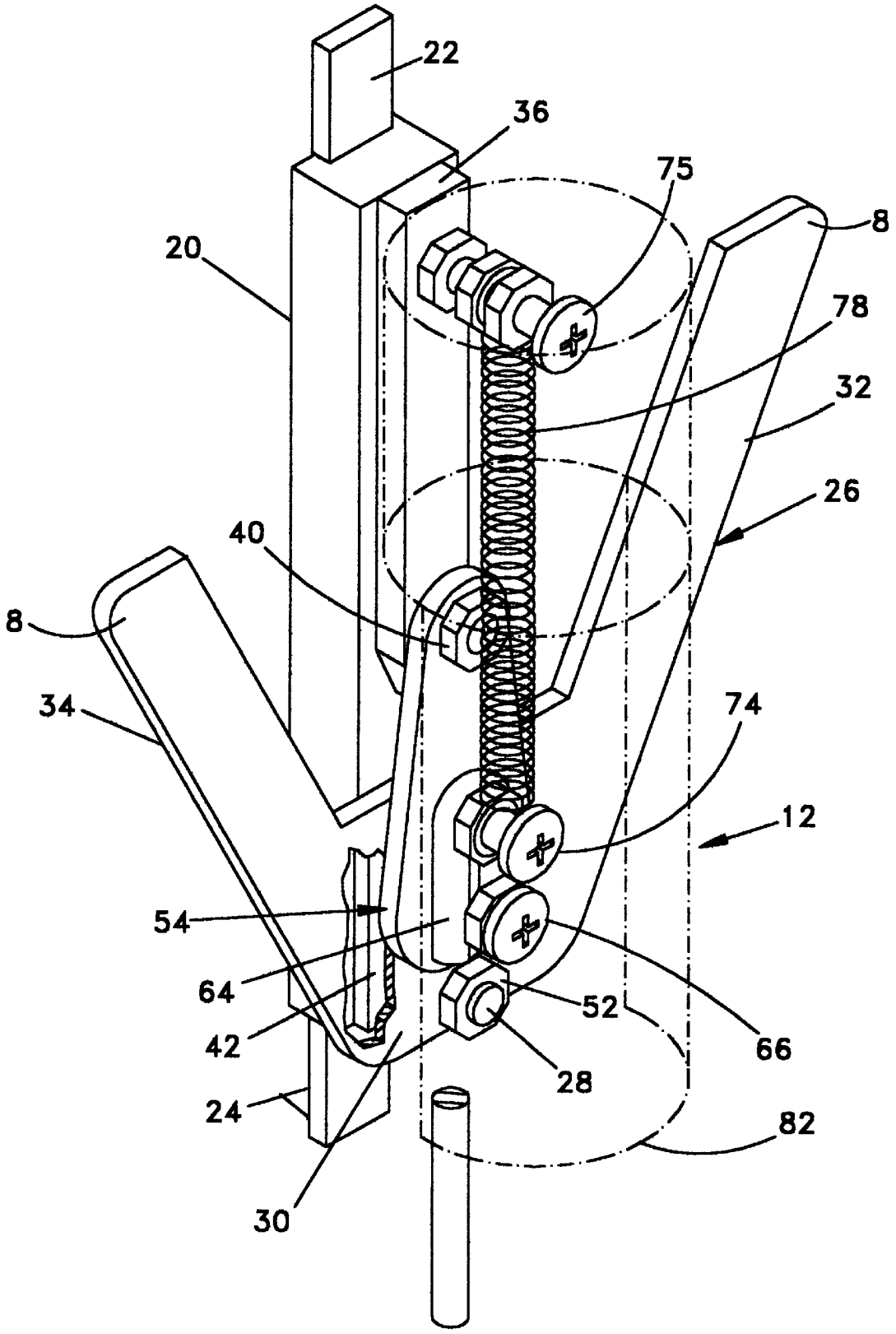
FIG. 2 is a perspective view of the actuator mechanism for the pick up arm of FIG. 1.

FIG. 2 is a perspective view of the actuator mechanism 12. As seen in FIG. 2, mechanism 12 includes a base member 20 having a pair of extending portions 22 and 24 at opposite ends thereof for secured relation to the cane by the clamp 18 (FIG. 1). A V-shaped element or member 26 is pivotally secured to base 20 by a screw 28 (FIGS. 2 and 3) and includes a forward apex area 30 from which a pair of fingers or arms 32 and 34 extend. Arms 32 and 34 extend rearwardly from apex area 30 and in angular relation therewith.

Figure 3:
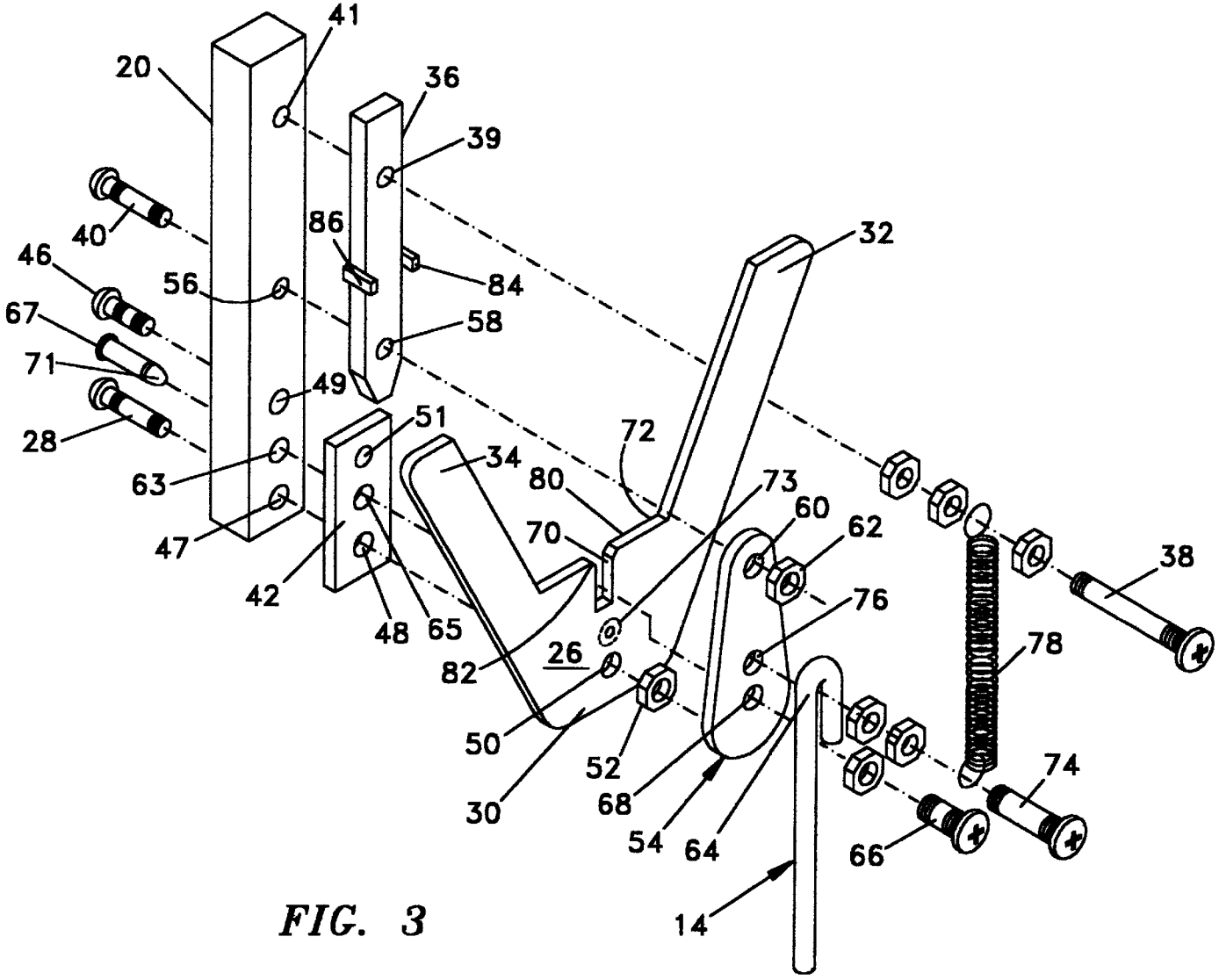
FIG. 3 is an exploded view of the actuator mechanism of FIG. 2.

As more clearly shown in FIGS. 2 and 3, base member 20 has a rear raised section 36 secured thereto by screws 38 and 40. Screw 38 extends through an opening 39 (FIG. 3) in raised section 36 and is secured in a threaded opening 41 of base member 20. As more clearly seen in FIG. 3, a forward raised section 42 is secured to base member 20 by screws 28 and 46. Screw 28 extends through openings 47, 48, and 50, respectively, of base member 20, forward raised section 42, and the forward apex area 30 of V-shaped member or element 26. The arm member is rotatably secured to the forward raised section 42 by screw 28 and a nut 52. Screw 46 extends through an opening 49 of base member 20 and is secured in a threaded opening 51 of raised section 42.

To enable extendible arm 14 to be rotated from a non-extended position parallel to the axis of the cane to an extended position normal to the axis of the cane responsive to engagement of either wing 32 or wing 34 with surface 16, an extendible, spring biased rotatable arm support member 54 is provided. An arm support member 54 is rotatably mounted to rear raised section 36 by screw 40 which extends through openings 56, 58 and 60, respectively, of base member 20, raised section 36 and arm support member 54. Screw 40 is secured by a nut 62 adjacent the upper surface of arm support member 54. Extendible arm 14 has its end 64 secured to arm support member 54 by a screw 66 which extends respectively through arm 14, an opening 68 (FIG. 3) of support member 54 and protrudes into a slot 70 provided in the rear surface 72 of apex area 30 of V-shaped member 26 to retain support member 54 and arm 14 in non-rotated position. Screw 66 locks arm support member to V-shaped element or member 26 when the member 26 is in a non-rotated position. Pin 66 is released from the slot 70 upon rotation of wing 26 as described hereinbelow. A second screw 74 also secures arm 14 to arm support member 54. Screw 74 extends through end 64 of arm 14 and into a threaded opening 76 of arm support member 54.

Figure 4:
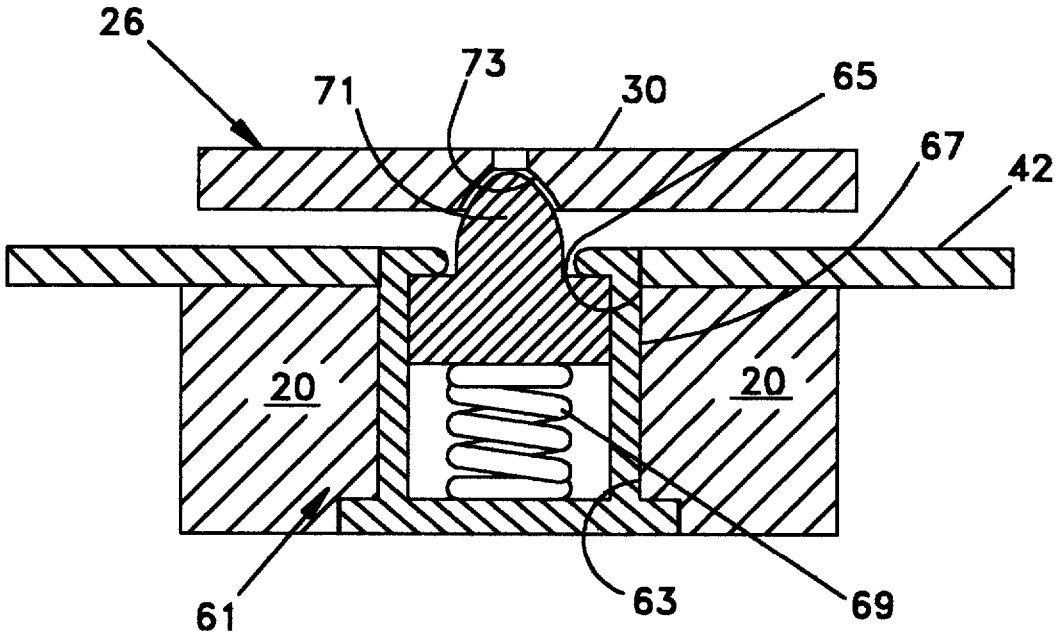
FIG. 4 is a sectional view of the locking device used to hold the wing in its normal unactuated position. The view illustrates the locking device in locked position with the wing member.

A "bullet catch" 61 (FIGS. 3 and 4) is mounted through opening 63 of base 20 and opening 65 of raised section 42. The "bullet catch" 61 is shown in FIG. 4 to include a housing 67 enclosing a spring 69 having a conically ended tip 71 secured thereto. One end of spring 69 is attached to the base of the housing and the second end of the spring is attached to tip 71. The housing 67 may be pressed into or threadably secured in openings 63 and 65. The under surface of the apex area 30 of V-shaped member 26 is shown in FIGS. 3 and 4 to be provided with a recessed or dimpled area 73 into which the tip 71 extends to lock the V-shaped member 26 in non-rotated position.

A spring 78 is secured between screw 38 and screw 74 to pivot arm support member 54 in an arcuate path about screw 40.

As seen in FIGS. 1 and 2 actuator mechanism 12 includes an arcuate housing member 82 which serves to cover and protect the components of mechanism 12 and also serves to roll the cane to either side to assure that one of the extending arms 32 and 34 will contact surface 16 responsive to the cane being inadvertently dropped thereon.

In operation, when the cane is inadvertently dropped by the user one of the extending arms 32 or 34 will engage or impact the surface 16 and will be rotationally displaced by the impact force to rotate a V-shaped member 26 about its pivot 28. As the V-shaped member 26 is moved in its arcuate path about pivot 28 spring 69 of "bullet catch" 61 is compressed to allow tip 71 to move out of recess 73 and thus allow the V-shaped member 26 to freely rotate. As the V-shaped member rotates the arm support member 54 is urged off-center as a result of screw or pin 66 riding over either of the curved surfaces 80 or 82 adjacent slot 70. Once arm support member 54 has been urged to its off-center position, spring 78 continues to rotate the arm support member until it engages one of the stops 84 or 86 provided on section 36 of base member 20. Stops 84 and 86 are provided with means to retain the V-shaped member against the stops. FIG. 3 illustrates this retaining means as Velcro strips 85 positioned on the stops, and, strips 87 positioned on the inner edges 89 and 91, respectively, of arms 32 and 34. Other retaining mechanisms may be resorted to, if desired. For example, a resilient finger like member may extend from each stop member to frictionally engage a surface of arm 32 or 34 and retain the engaged arm 26 against the stop which it has engaged. Rotational movement of arm support member 54 moves extendible arm 14 to the position shown in FIG. 1, thereby enabling the user to retrieve the fallen cane without bending. Once the cane has been retrieved the user merely moves the arm back to its unextended position where it remains until the actuator mechanism is again actuated. Of course, with the arm in its unextended position the tip 71 of the "bullet catch" is engaged, spring biased relation in recessed area 73 of the assembly, and, pin or screw 66 is positioned into slot 70 of the V-shaped member.

Figure 5:
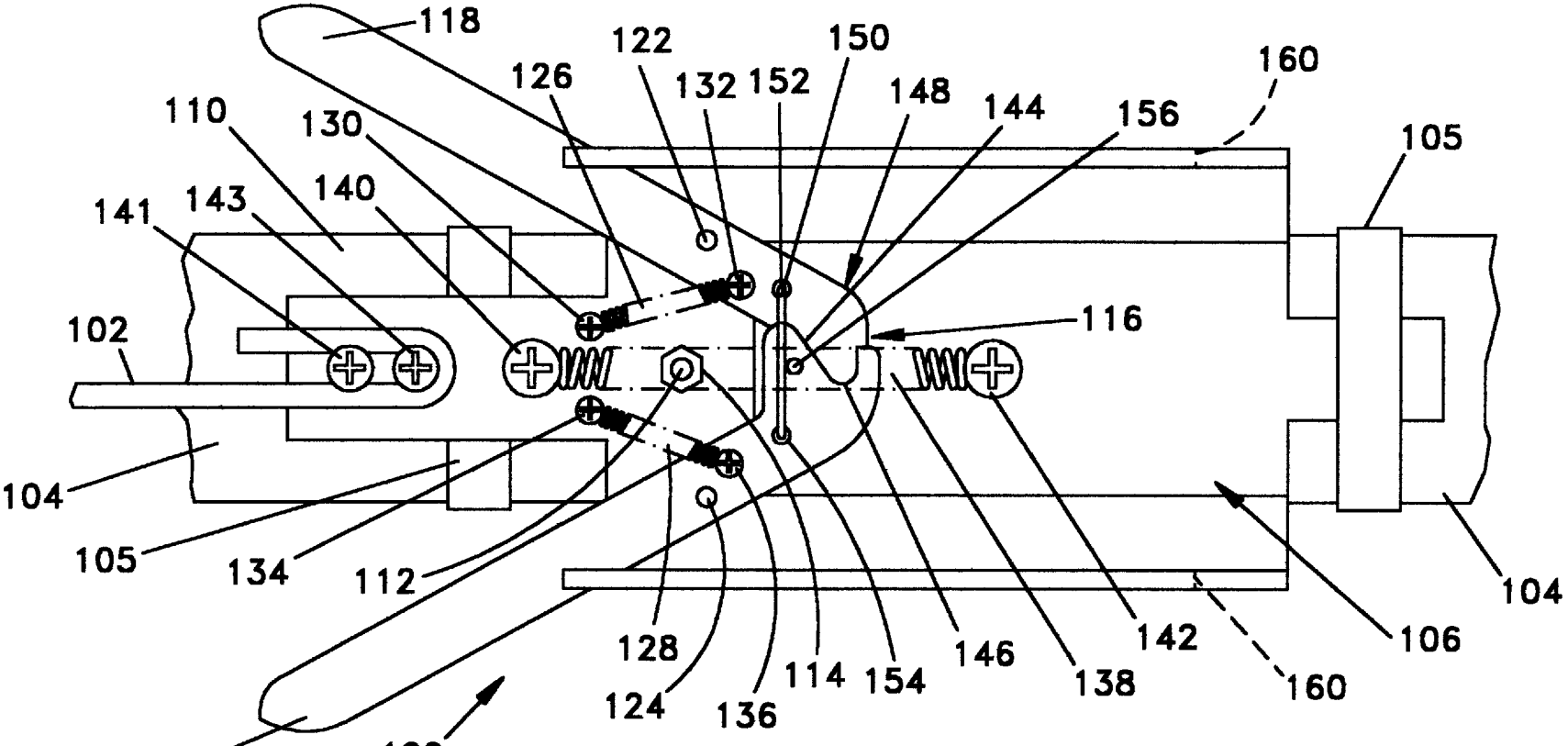
FIG. 5 is a plan view of another embodiment of an actuating mechanism for extending an arm from a cane as shown in FIG. 1.
Figure 6:
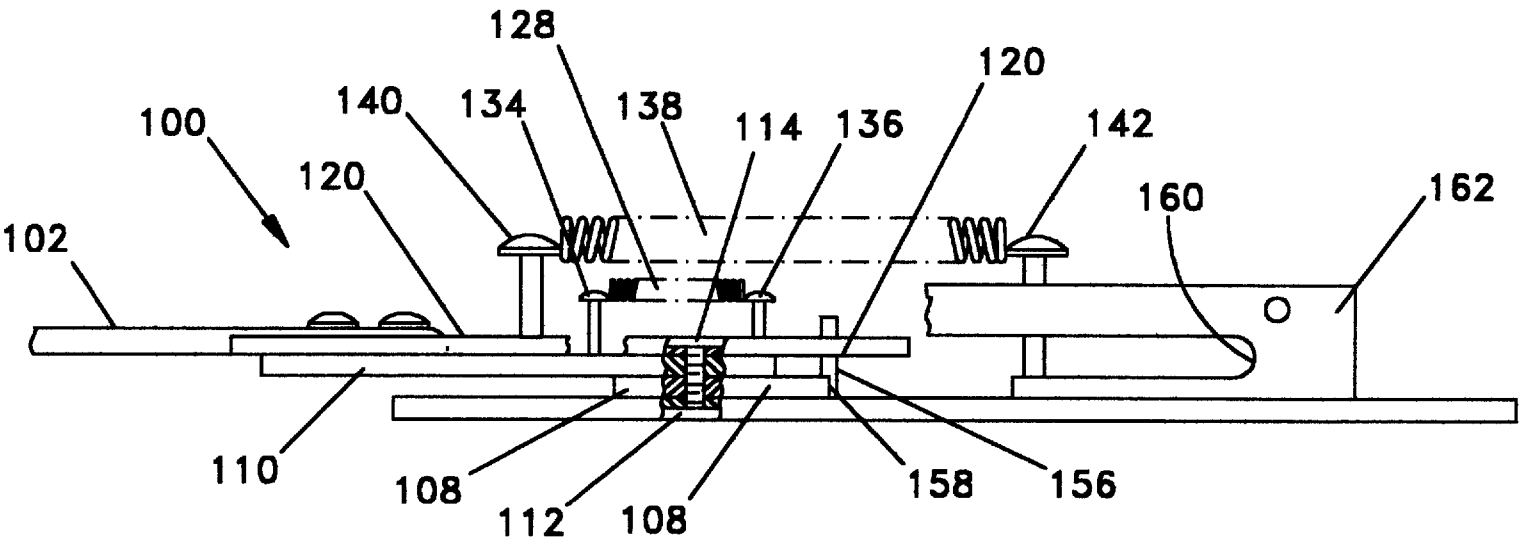
FIG. 6 is a top view of the actuating mechanism of FIG. 4.
Figure 7:
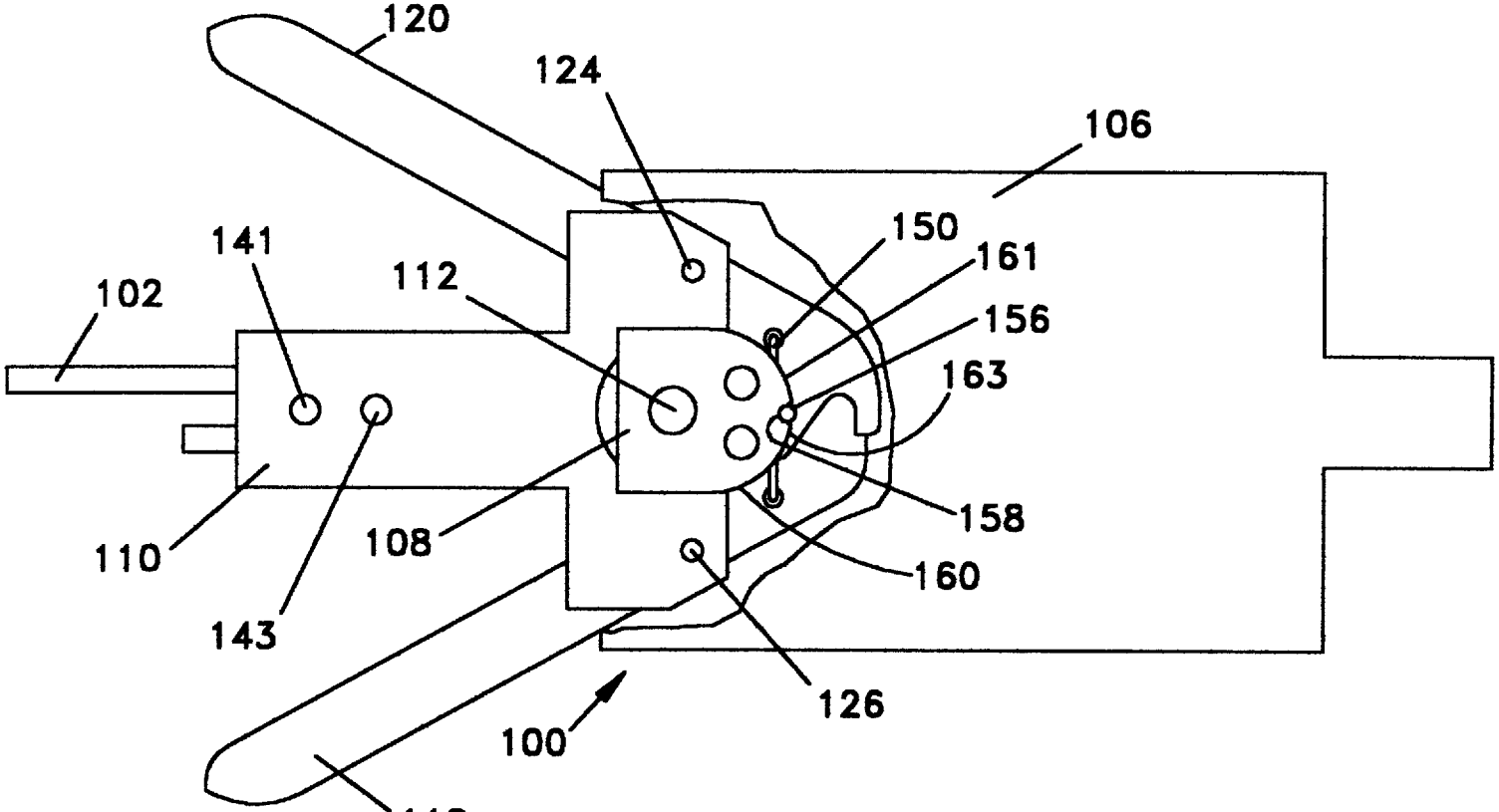
FIG. 7 is a bottom view of the actuating mechanism of FIG. 5. The base is partially broken away to show the cam mechanism of the device.

Another embodiment of the present invention is illustrated in FIGS. 5, 6 and 7. As seen in FIG. 5, 6 and 7 an actuator mechanism 100 is provided for extending an arm 102 to a position which is normal to the axis of a cane 104 to which it is attached by clamps 105. Actuator 100 is shown to include a base 106 having a cam 108 (FIG. 6) rigidly secured thereto. A rotatable extendible arm support member 110 is secured to cam 108. The rotatable arm support member 110 is mounted for rotational movement relative to cam 108, and, both cam 108 and arm support member 110 is secured to base 106 by a screw 112 and nut 114 (FIG. 6). A V-shaped assembly 116 is mounted to arm support member 110 to impart rotational movement thereto. V-shaped assembly 116 includes a pair of extending fingers or arms 118 and 120 which are respectively pivotally mounted to arm support member 110 by pins 122 and 124. Fingers 118 and 120 are also spring biased to arm support member 110 by springs 126 and 128. Spring 126 extends between a screw or pin 130 secured to arm support members 110 and a screw of pin 132 secured to finger 118. Spring 128 extends between a screw or pin 134 secured to arm support member 110 and a screw or pin 136 secured to finger 120. The arm support member is spring biased to base 106 by a spring 138. Spring 138 extends between a screw or pin 140 mounted on arm support member 110 and a screw or pin 142 mounted on base 106. An extendible arm 102 is secured to arm support member 110 by screws 141 and 143 as shown in FIGS. 5 and 6.

Fingers 118 and 120 are provided with complimentary curved mating surfaces 144 and 146 at the apex portion 148 of the V-shaped assembly. A clip member or spring 150 secures the fingers 118 and 120 together in relative movable relation. Member 150 is secured in holes 152 and 154 provided in fingers 118 and 120 respectively. A downwardly pin 156 (FIG. 6) extends from the bottom surface of finger 120 and protrudes into a groove 158 provided in a curved surface 160 of cam 108 (FIG. 7).

In operation, when the cane is inadvertently dropped by the user one of the extending fingers 118 or 120 will engage the surface on which the cane has fallen and will be displaced by the impact force to rotate V-shaped assembly 116 about pivot (screw) 112. In response to V-shaped assembly rotation the pin 156 is moved out of groove 158 of cam 108 and either spring 126 or 128 will further rotate the V-shaped assembly in the direction away from the impact point of the V-shaped assembly and the surface upon which the cane has fallen. As pin 156 is moved out of groove 158, mating surfaces 144 and 146 will slightly separate (approximately 1/16 of an inch) to permit pin 156 to ride over surfaces 161 and 163 adjacent the groove 158 (FIG. 7) and prevent binding of the pin in groove 158. Rotation of the V-shaped assembly causes arm support member 110 to rotate carrying extendible arm 102 with it until a finger of the V-shaped assembly engages a stop 160 provided on a housing 162 which encloses the actuating components. Housing 162 is shown broken away in FIG. 5; however, it is provided with an upper arcuate surface similar to the arcuate surface 82 of FIG. 1. The arcuate surface assures that the cane is rolled over to a position whereby tip of portion (8) of a respective finger of the V-shaped assembly will engage the surface upon which the cane has fallen.

Figure 8:
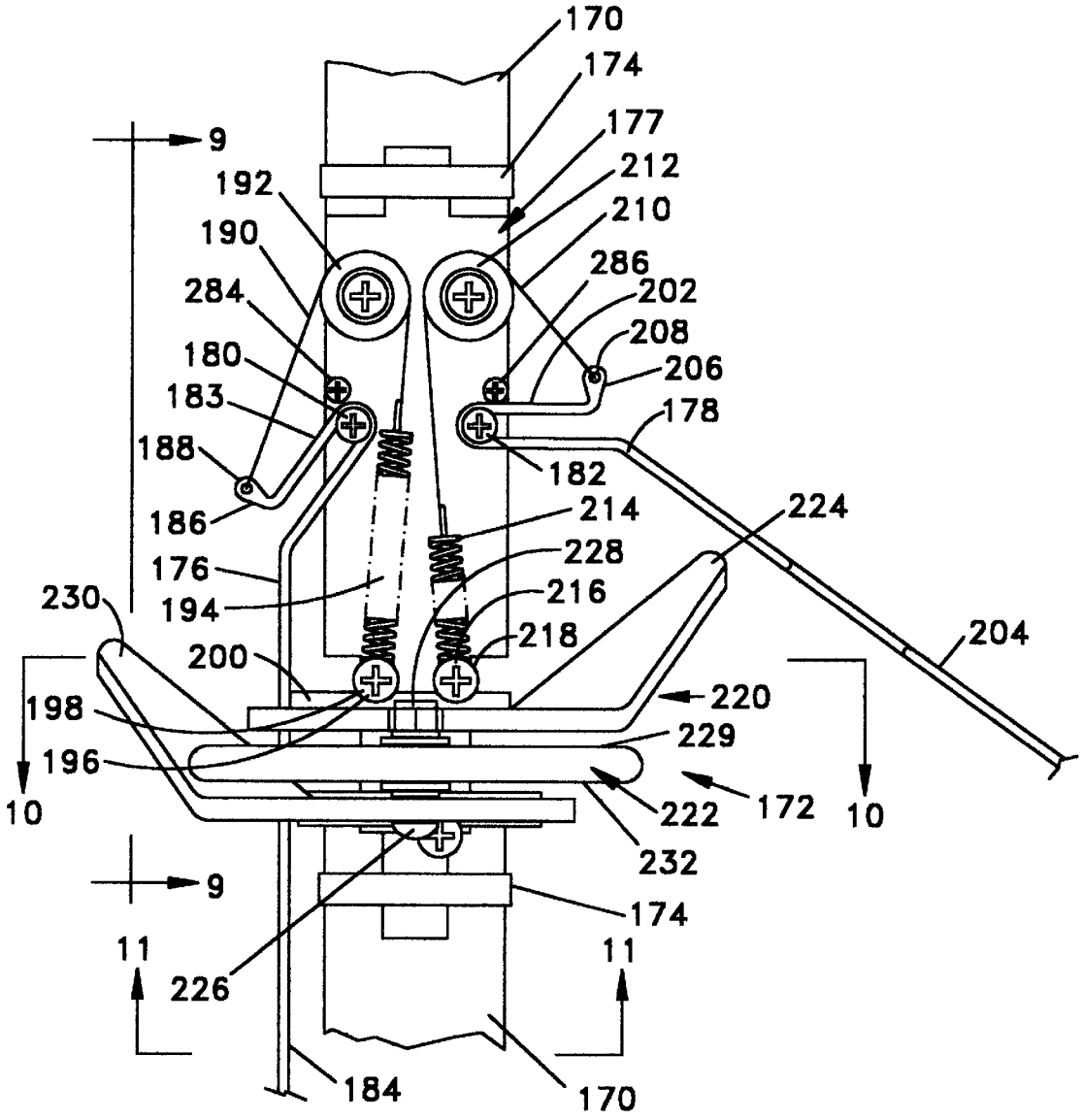
FIG. 8 is a plan view of another embodiment of the present invention which uses a pair of extendible arms.
Figure 9:
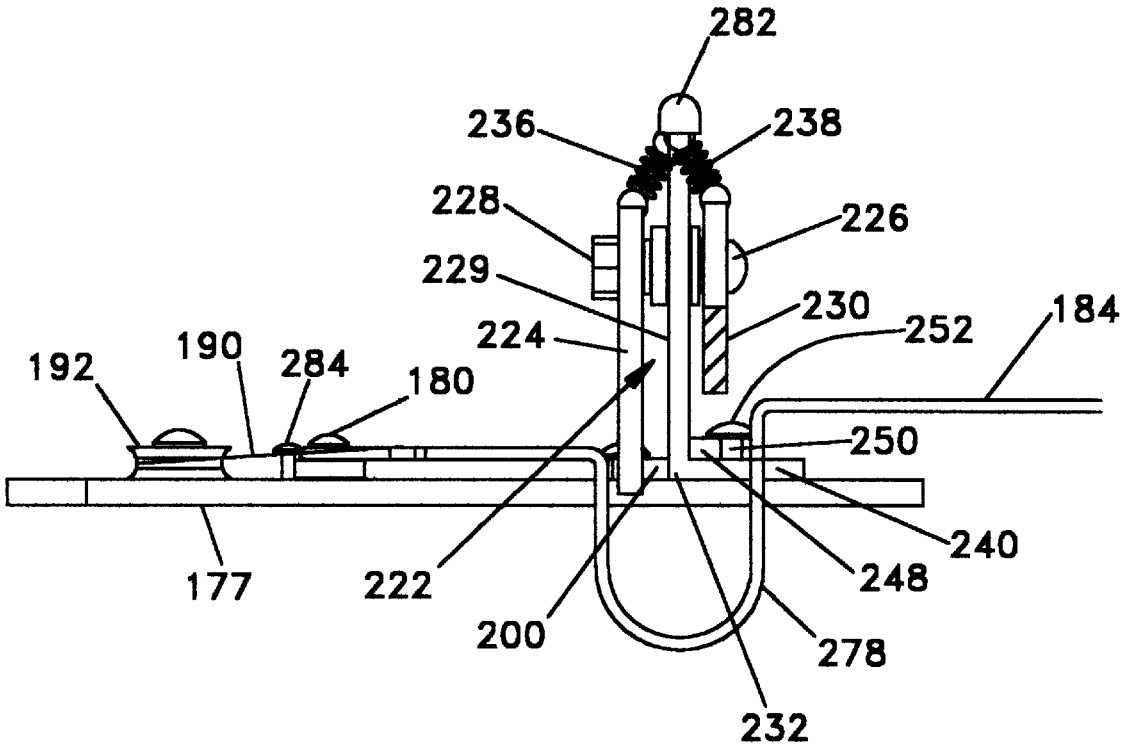
FIG. 9 is a view taken along line 8—8 of FIG. 7.

FIGS. 8–11 illustrate another embodiment of the invention wherein a pair of extendible arms are provided. As seen in FIG. 8, a cane 170 is shown to have an actuator mechanism 172 secured thereto by clamps 174. Actuator mechanism 172 is shown to be provided with a base plate 177 having a pair of extendible rotatable arms 176 and 178 pivotally secured thereto by pins or screws 180 and 182, respectively. Arm 178 is shown in FIG. 7 as being partially extended away from base plate 177. Arm 176 includes an upper curved portion having a downwardly extending short arm portion 183 and a downwardly extending elongated arm portion 184 which extends along the side of cane 170 and a tip portion (260). Screw 180 extends through the U-shaped juncture of arm portions 182 and 184 for secured relation of arm 176 to base plate 177. Short arm portion 183 includes an extending distal end portion 186 having an opening 188 to which one end of a thin wire cable 190 is attached. Wire 190 extends over a pulley 192 which is rotatably secured to base plate 177 and attaches to a spring 194 which is secured to a pin or screw 196 secured to base plate 177 and having a substantially large diameter head 198 under which a spring biased slide bar 200 is retained.

In like manner, arm 178 includes an upper curved portion having a downwardly extending short arm portion 202 and a downwardly extending elongated arm portion 204. A screw 182 extends through the U-shaped juncture of arm portions 202 and 204 for secured relation of arm 178 to base plate 177. Short arm portion 202 includes a distal end portion 206 having an opening 208 to which one end of a thin wire cable 210 is attached. Wire 210 extends over a pulley 212 which is rotatably secured to base plate 177 and attaches to a spring 214 which is secured to a pin or screw 216 which is secured to base plate 177 and is provided with a substantially large diameter head 218 under which slide bar 200 is retained.

Figure 10:
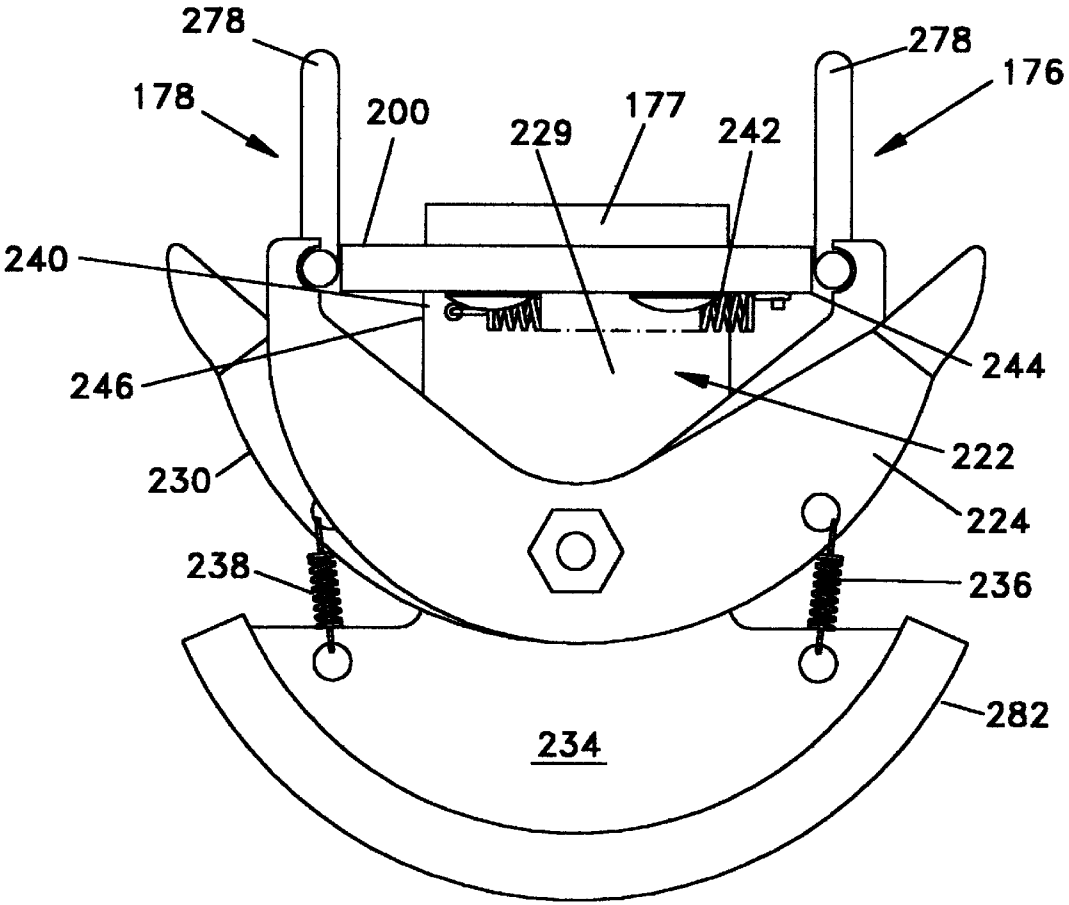
FIG. 10 is a view taken along line 9—9 of FIG. 7.
Figure 11:
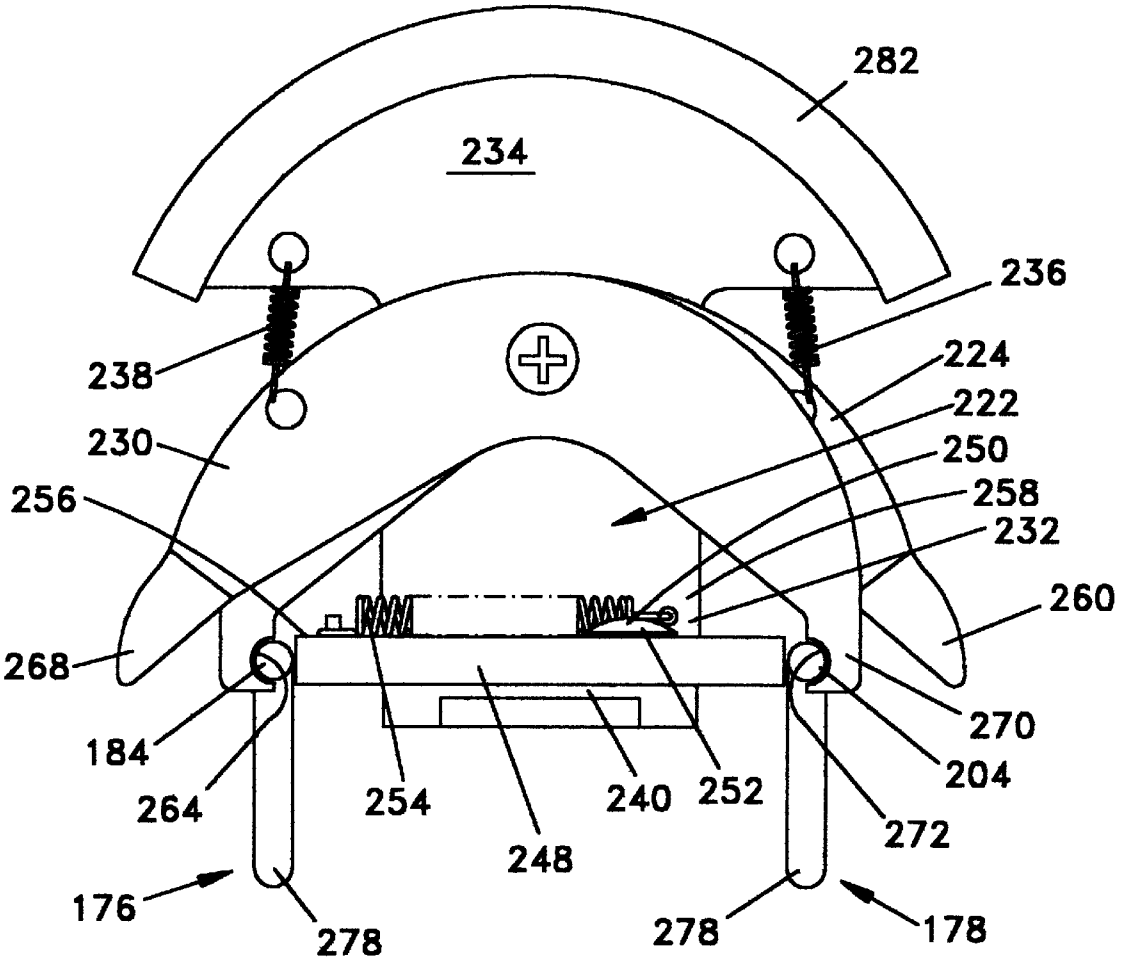
FIG. 11 is a view taken along line 10—10 of FIG. 7.

An assembly 220 is mounted to base plate 177 to retain the arms 176 and 178 in unextended position and to release arms 176 and 178 for extended relation normal to the axis of the cane. Assembly 220 includes an L-shaped support member 222 (FIG. 9) mounted to and extending normally from base plate 177. A first member 224 is rotatably attached by a screw 226 and nut 228 to the top surface 229 of support member 222. In like manner a second member 230 is rotatable secured by screw 226 and nut 228 to the bottom surface 232 of support member 222. As seen in FIG. 10, member 224 is spring biased to a forward portion 234 of support member 222 by a spring 236 and member 230 (FIG. 11) is spring biased to forward portion 234 of support member 222 by a spring 238.

Slide member 200 (FIGS. 9 and 10) is positioned on the base plate 177 against the base portion 240 (FIG. 9) of the upper surface 229 of support member 222. A spring 242 (FIG. 10) has one end secured adjacent one end 244 of slide member 200 and has its second end secured adjacent edge 246 of support member 222. A second slide member 248 (FIGS. 9 and 11) is positioned against the L-shaped base portion 240 of support member 222 which extends from the lower surface 232 of support member 222. A screw 250 secures slide member to base plate 177 and retains the slide member under a substantially large diameter head 252. A spring 254 is secured adjacent end 256 of slide member 248 and to an edge 258 of support member 222.

Member 224 includes an end or tip portion 260 (FIG. 11) extending beyond an edge of base plate 177. Tip 260 is disposed for engaging the surface to which the cane has fallen. The second end 262 of arcuate member 224 is provided with a notch 264 to receive elongated arm 184 therein. Elongated arm 184 is held in notch 264 by end 244 of slide member 200.

Member 230 includes an end or tip 268 (FIG. 11) extending beyond an edge of base plate 177. Tip 268 is disposed for engaging the surface to which the cane has fallen. The second end 270 of arcuate wing-like member 230 is provided with a notch 272 therein. Elongated arm 204 is held in notch 272 by an end 274 of slide member 248.

It should be noted that each of the arms 176 and 178 is provided with a downwardly curved area portion 278 to provide clearance for the tips 260 and 268 of the members 224 and 230 when they are rotationally displaced. It should also be noted that stops 284 and 286 are provided on the base plate to limit the rotational movement of arms 176 and 178.

A resilient member 282 is provided on the upper curved surface of support member 222 to protect the user from contacting the curved metal surface of member 222 and to provide a degree of resiliency to the surface contacting portion of the actuator.

In operation, if the cane is inadvertently dropped, one of the extending tips 260 or 268 (FIG. 11) will engage the surface upon which the cane has fallen and will respectively rotationally displace either member 224 or member 230. If member 224 is rotationally displaced, slide 200 is biased outwardly by spring 242 to urge arm 176 in an outward direction. After being initially urged outwardly by slide 200, spring 194 exerts a further rotational force on the end 188 of arm 176 to rotate arm 176 to the extended position.

In a similar manner, if member 230 is rotationally displaced, slide 248 is biased outwardly by spring 254 to urge arm 178 in an outward direction. After being initially urged outwardly by slide 248, spring 214 exerts a further rotational force on the end 206 of arm 178 to rotate arm 178 to the extended position.

Figure 12:
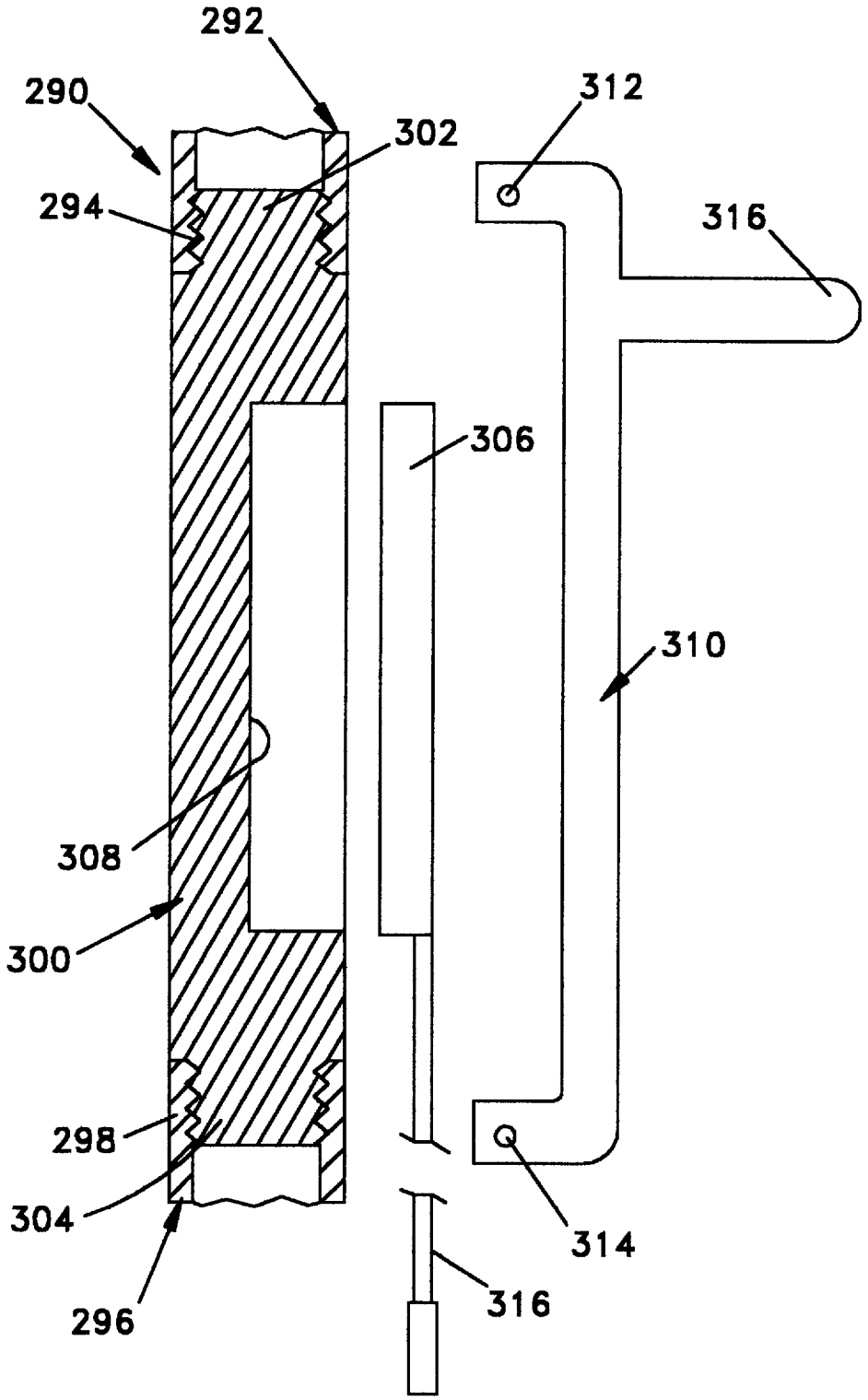
FIG. 12 is an exploded elevational view of another embodiment of the present invention.

An alternate embodiment of the present invention is illustrated in FIG. 12 which is an elevational sectional view diagrammatically illustrating the actuators of the present invention as being integral with a cane. It is understood that any of the previously discussed actuator mechanisms may be used in this embodiment. As seen in FIG. 12 a hollow cane 290 is shown to include an upper section 292 having a lower internally threaded portion 294 and a lower section 296 having an upper internally threaded portion 298. Sections 292 and 296 are joined together by a solid insert member 300. Member 300 includes an upper externally threaded portion 302 which is threadably secured to lower portion 294 of the cane. Insert member 300 further includes a lower externally threaded portion 304 which is threadably secured to the lower section 296 of the cane.

An actuator mechanism designated by the numeral 306 is shown for attachment to the inner surface 308 of section 300. The actuator, indicated by numeral 306, may be any of the aforementioned actuators 12, 100 and 172 of the invention. Surface 308 serves as the base to which the components of the actuators are mounted. A cover 310 is disposed for secured relation to the cane by screws or the like insertable into holes 312 and 314 of the cover and secured to sections 302 and 304, respectively of the solid cut-away member 300. A semi-circular member is secured to the cane to assure that the cane rolls over to a position which assures that the wings of the actuator engage the surface to which the cane has fallen as discussed, supra.

It is to be understood that while the actuator mechanisms of the present invention has been discussed in conjunction with walking canes this is not to be taken in a limiting sense since the actuator mechanisms may be also used in conjunction with crutches or a blind persons feeler "stick". However, when used with such a stick it may be desirable to provide a bend or knob at the distal end of the extendible arm to provide a larger area for the blind person to search for.

Figure 13:
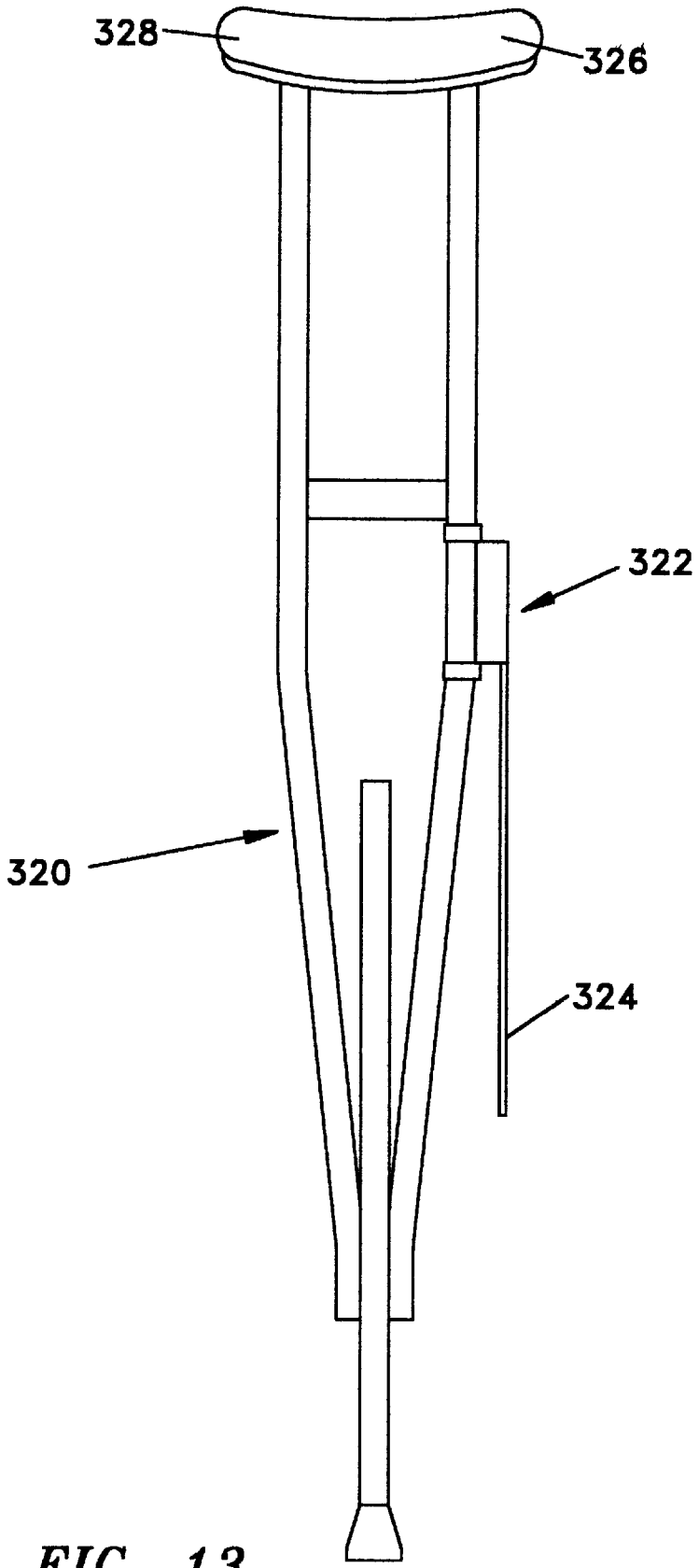
FIG. 13 is an elevational view of the actuator mechanism being used in conjunction with a crutch.

FIG. 13 illustrates the actuators of the present invention as being used with a crutch. It is to be understood that any of the previously discussed actuator mechanisms may be used in this embodiment. As seen in FIG. 13 a crutch 320 is shown to be provided with an actuator mechanism denoted by the numeral 322 attached thereto. The actuator mechanism may be any of the above discussed actuators. As seen in FIG. 13 an extendible arm 324 extends downwardly from the actuator mechanism 322 for extended relation from the crutch 320 upon impact with the actuator mechanism, as discussed supra. Should the crutch fall on either of the end surfaces 326 or 328 it will roll over to a position which will cause the actuating arms of any of the previously discussed mechanisms to engage the surface and extend the arm 324.

It is to be understood that while the invention has been described with respect to preferred embodiments, it will be apparent to those skilled in the art that changes may and modifications may be resorted to that are within the spirit and scope of the appended claims. For example, in the embodiment of FIGS. 1–3, raised portions 36 and 42 are identified as being distinct members secured to the base, however, if desired, the base may be machined to have these raised sections integral therewith. If desired, raised section 42 may be completely omitted since it is only required that the plane in which arm support member 54 is located be above the plane in which the wing-shaped member 26 is positioned. Also, in the embodiment of FIGS. 5–7 the cam member is shown to be secured to the base by a screw. However, if desired, the cam member may be formed directly on the base as an integral part thereof. Additionally, in the embodiment of FIGS. 8–11 the support member is shown and described as an L-shaped member which is secured to the base. However, if desired, the support member may be a straight upstanding member formed integral with the base. Accordingly, it is to be understood that all matters contained in the above description or shown in the accompanying drawing shall be interpreted as illustrative and not in limiting sense.

I claim:

1. An actuator mechanism for extending an arm from an elongated walking appliance responsive to said walking appliance falling to a surface to enable said appliance to be retrieved without requiring bending over by the user comprising:

at least one extendible arm means provided on said actuator mechanism; and actuating means for extending said at least one extendible arm from said actuator mechanism in a direction upwardly and away from the surface upon which said walking appliance has fallen, said actuating means disposed for extending said extendible arm in response to impact of said actuator mechanism with said surface upon which said actuating mechanism has fallen.

2. An actuator mechanism as in claim 1 wherein said walking appliance is a walking cane.

3. An actuator mechanism for extending an arm from a fallen elongated walking appliance to enable said appliance to be retrieved without requiring bending over by the user comprising:

at least one elongated arm, spring biased to said actuator mechanism;

means for extending said at least one elongated arm from said actuator mechanism responsive to impact of said actuator mechanism with the surface on which said walking appliance has fallen;

a base member disposed for attachment to said walking appliance, said means for extending said at least one elongated arm includes a V-shaped element having a pair of oppositely extending arms, said V-shaped element rotatably attached to said base member for rotation between first and second positions responsive to engagement of a said arm of said V-shaped element with the surface to which the cane has fallen, said at least one said elongated arm disposed for extending from a first non-extended position to a second extended position substantially normal to said walking appliance responsive to rotation of said V-shaped element to said second position.

4. An actuator mechanism as in claim 3 including a spring biased arm support member having said at least one elongated arm secured thereto for rotation therewith, said arm support member being rotatably secured to said base member and disposed for coacting with said V-shaped element for rotation to extend said at least one elongated arm in substantially normal relation from said elongated walking appliance.

5. An actuator mechanism as in claim 4 including a spring connected to said base and to said arm support member to rotatably bias said arm support member from a first non-rotated position to a second rotated position, whereby said at least one said arm is rotated to said extended position.

6. An actuator mechanism as in claim 5 including first retaining means to retain said V-shaped element in said first position prior to impact of said actuating mechanism with said surface and to release said V-shaped element for rotation to said second position responsive to impact of a said arm of said V-shaped element with said surface.

7. An actuator mechanism as in claim 6 wherein said V-shaped element is provided with a lower surface having a recess therein and said first retaining means is a member secured to said base member and having a spring biased tip portion for extending into said recess to retain said V-shaped element member in said first position.

8. An actuator mechanism as in claim 7 including second retaining means for retaining said spring biased arm support member in a first non-rotated position and for release of said spring biased arm supporting member to said second rotated position whereby said at least one extendible arm is displaced to its extended position.

9. An actuator mechanism as in claim 8 including means for positioning said actuator in a position of engagement of a said arms of said V-shaped element with said surface responsive to impact of said actuator mechanism with said surface.

10. An actuator mechanism as in claim 9 wherein said means for positioning said actuator is a housing carried on said actuator mechanism and having an arcuate outer surface.

11. An actuator mechanism as in claim 3 including stop means to limit rotation of said V-shaped element.

12. An actuator mechanism as in claim 3 including a support member having first and second end portions, said V-shaped element being secured to said first end portion and spring biased to said base member for rotation, said at least one extendible arm secured to said second end portion, said V-shaped element being rotatably secured to said base member.

13. An actuator mechanism as in claim 12 wherein said V-shaped element is comprised of two discrete arm members, each of said arm members being individually spring biased to and pivotally mounted on said base member.

14. An actuator as in claim 13 including releasable locking means to retain said V-shaped element in said first position and to permit rotation of said V-shaped element to said second position responsive to engagement of a said arm with said surface.

15. An actuator mechanism as in claim 14 wherein said releasable locking means includes a cam secured to said base and having an arcuate peripheral surface provided with a groove therein, and a pin depending from said V-shaped element for locked relation in said groove and for unlocked relation from said groove responsive to rotation of said V-shaped element.

16. An actuator as in claim 15 including a housing for substantially enclosing said support member, and said V-shaped element, said housing having an arcuate surface for positioning said actuator mechanism in a position which assures contact of an arm of said V-shaped element with said surface.

17. An actuator mechanism as in claim 16 including stop means for limiting the rotation of said V-shaped element.

18. An actuator mechanism as in claim 1 including a base member, actuating means and a pair of individually extendible arms rotatably secured to said base member and having first and second ends, and, means for discretely extending a said arm from a first non-extended position to a second extended position.

19. An actuator mechanism as in claim 18 wherein said means for discretely extending a said arm includes a pair of arm extending assemblies, each having a member provided with surface engaging tip portions on opposite ends thereof, said arm extending assemblies disposed to discretely extend a said arm in substantially normal relation with said walking appliance responsive to engagement of a said tip portion of a said member with said surface.

20. An actuator mechanism as in claim 19 wherein each of said arm extending assemblies includes a pulley rotatably mounted on said base member, a spring having first and second ends, said first end of said spring secured to said base member, a wire cable having first and second ends, said wire cable extending over said pulley and having said first end secured to said first end of each said pair of arms and said second end secured to said spring.

21. An actuator mechanism as in claim 20 wherein said base member includes an upstanding portion and wherein each said arm extending member is pivotally secured to said upstanding portion.

22. An actuator mechanism as in claim 21 including means for discretely urging each said arm to said extended position responsive to impact of one said tip portions with said surface.

23. An actuator mechanism as in claim 22 wherein said pair of extending arm assemblies includes a spring biased slide bar which provides an initial rotation imparting force to each said member responsive to engagement of a said tip portion of a said member with said surface.

24. An actuator as in claim 23 wherein said spring secured to said arm continues to rotate said arm to an extended position responsive to rotation of a tip portion.

25. An actuating mechanism as set forth in claim 24 wherein each said tip portion includes locking means for retention of said arms in unextended position and for release of said arms for extended relation responsive to rotation of said V-shaped members.

26. An actuator mechanism as in claim 1 wherein said walking appliance is a crutch.

27. A walking appliance comprising:

extendible arm means for extending from said appliance to enable a user to pick-up said appliance after said appliance has fallen to a surface and without requiring substantial bending by the user; and actuating means including an assembly including a pair of oppositely extending surface engaging arms, said actuating means disposed for actuating said extendible arm means for extended relation thereof from said walking appliance in an upward direction away from said surface responsive to a said surface engaging arm of said pair of oppositely extending surface engaging arms engaging said surface upon which the walking appliance has fallen.

* * * * *